US010014584B1

(12) United States Patent
Tonn

(10) Patent No.: US 10,014,584 B1
(45) Date of Patent: Jul. 3, 2018

(54) SLOTTED ANTENNA WITH UNIAXIAL DIELECTRIC COVERING

(71) Applicant: David A Tonn, Charlestown, RI (US)

(72) Inventor: David A Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 130 days.

(21) Appl. No.: 15/205,234

(22) Filed: Jul. 8, 2016

(51) Int. Cl.
*H01Q 13/12* (2006.01)
*H01Q 1/48* (2006.01)
*H01Q 9/04* (2006.01)

(52) U.S. Cl.
CPC ..... *H01Q 13/12* (2013.01); *H01Q 1/48* (2013.01); *H01Q 9/0485* (2013.01)

(58) Field of Classification Search
CPC ..... H01Q 13/12; H01Q 13/14; H01Q 15/08; H01Q 9/38; H01Q 1/30; H01Q 1/34
See application file for complete search history.

(56) References Cited

U.S. PATENT DOCUMENTS

| | | | | |
|---|---|---|---|---|
| 9,407,010 | B1 * | 8/2016 | Tonn | H01Q 1/42 |
| 9,865,930 | B1 * | 1/2018 | Tonn | H01Q 13/12 |
| 9,865,931 | B1 * | 1/2018 | Tonn | H01Q 13/22 |
| 2002/0154067 | A1 * | 10/2002 | Gilbert | H01Q 1/04 343/909 |

* cited by examiner

*Primary Examiner* — Daniel J Munoz
(74) *Attorney, Agent, or Firm* — James M. Kasischke; Michael P. Stanley

(57) ABSTRACT

An antenna capable of being joined to an antenna feed perpendicular to a ground plane includes a conductive radiator and a cylindrical shell. The conductive radiator is tubular and has a longitudinal slot along the entire length thereof. The slot is parallel to the radiator's axis. The antenna feed can be connected across the slot. A cylindrical shell of a uniaxial dielectric material is provided outside and spaced apart from the conductive radiator and extends beyond ends of the conductive radiator. The cylindrical shell electrically contacts the ground plane. The shell is made from a material having a dielectric tensor with high impedance in the axial direction. This antenna gives enhanced bandwidth over ordinary slotted antennas. The shell can be applied to preexisting antennas.

20 Claims, 6 Drawing Sheets

SLOTTED ANTENNA WITH UNIAXIAL DIELECTRIC COVERING

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to a slotted antenna having enhanced broadband characteristics.

(2) Description of the Prior Art

Slotted cylinder antennas have been proposed in submarine applications before. For example, in U.S. Pat. No. 6,127,983, Rivera and Josypenko disclose a horizontally mounted slotted cylinder antenna for use in a towed buoy. Though somewhat broadband in performance, it is not suitable for vertical mounting over a groundplane. Removed from floating at the ocean's surface, the antenna becomes resonant and has a narrow bandwidth.

Slotted cylinder antennas are popular antennas for use in line of sight communications systems, especially where the carrier frequency exceeds 300 MHz. FIG. 1 provides a diagram of a prior art slotted cylinder antenna 10. Antenna 10 includes a metallic cylinder 12 having slot 14 cut into the wall of the cylinder 12. Cylinder 12 can be any thickness as long as skin effects are avoided. Slot 14 is parallel to an axis 16 of cylinder 12. Axis 16 is perpendicular to a ground plane 18. In the antenna shown, slot 14 extends the entire length of the cylinder 12. The interior of the cylinder or cavity is typically filled with air, but another dielectric material can be used.

FIG. 1 shows an end-fed version of this antenna, but this antenna can also be center-fed. In the end-fed version, a transmission line having a first conductor 20 is provided through the ground plane 18 and connected across the slot 14 near one end of the slot 14. A second conductor 22 is shown grounded to the ground plane 18. Transmission line can be either a balanced line, such as a twisted pair, or an unbalanced line, such as a length of coaxial line (shown). In either case, the feeding transmission line 18 must have two conductors in order to connect across slot 14. The optimal frequency of this antenna 10 is given by the length of the slot 14. The size of the cavity and the slot width govern bandwidth.

The dimensions of the antenna 10 components are critical to operating frequencies. Metallic cylinder 12 is typically made of copper and has an inner radius a, a thickness d and a height $h_1$. Cylinder 12 is raised above the ground plane 18 by a distance $h_2$ so that it is not in contact with the ground plane. Slot 14 has a width w. Slot 14 is cut so that it extends the entire length of cylinder 12. Slot 14 is parallel to axis 16.

In this embodiment, antenna 10 is fed by a coaxial feed arrangement that penetrates the ground plane 18 beneath the antenna 10. Outer conductor 22 of the coaxial feed is connected to ground plane 18 and to the bottom of cylinder 12 on the right hand side of slot 14. Center conductor 20 of the coaxial feed is connected to the bottom of cylinder 12 on the left hand side of slot 14. The coaxial feed is designed to have a standard 50 Ohm characteristic impedance.

FIG. 2 shows a computed voltage standing wave ratio (VSWR) for this antenna. The VSWR is a figure of merit used in determining the impedance bandwidth of the antenna. Typically this bandwidth is the continuous range of frequencies for which VSWR<3:1. For the example shown in FIG. 2, resonant character of the antenna can be seen in the oscillatory nature of the VSWR curve, and modest bandwidth in each passband. FIG. 3 shows the modeled gain of this antenna. This antenna has modest to good gain (2-8 $dB_i$) in its passbands. There is a cutoff frequency, $f_c$, above the greater passband. Above this frequency, the slotted cylinder behaves as a radiating slot.

SUMMARY OF THE INVENTION

It is a first object of the present invention to provide a vertically deployable antenna.

Another object is to provide such an antenna capable of utilizing the ocean surface as a ground plane.

Yet another object is to provide such an antenna with higher bandwidth than heretofore known while preserving gain.

Accordingly, there is provided an antenna that is capable of being joined to an antenna feed perpendicular to a ground plane. The antenna includes a conductive radiator and a cylindrical shell. The conductive radiator is tubular and has a longitudinal slot along the entire length thereof. The slot is parallel to the radiator's axis. The antenna feed can be connected across the slot. A cylindrical shell of a uniaxial dielectric material is provided outside and spaced apart from the conductive radiator and extends beyond ends of the conductive radiator. The cylindrical shell electrically contacts the ground plane. The shell is made from a material having a dielectric tensor with high permittivity in the axial direction. This antenna gives enhanced bandwidth over ordinary slotted antennas. The shell can be applied to preexisting antennas. The antenna can be structurally enhanced by providing dielectric material inside the conductive radiator and between the conductive radiator and the cylindrical shell.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 4:
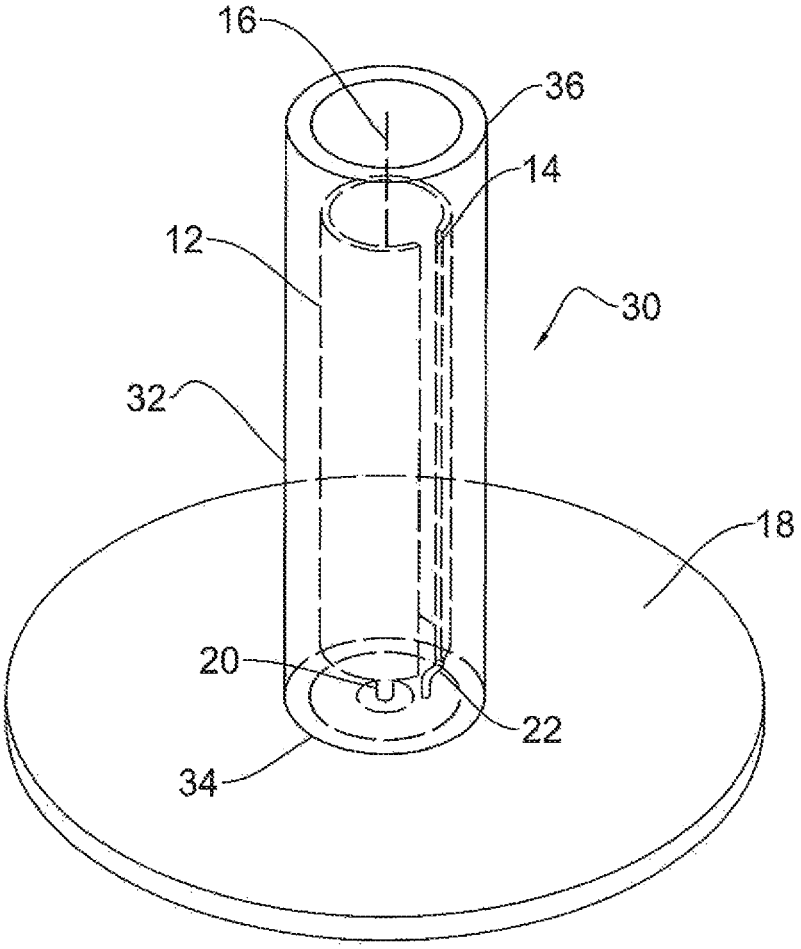
FIG. 4 is a perspective view one embodiment of an antenna in accordance with the current invention.

In FIG. 4, there is shown an embodiment of an antenna 30. Antenna 30 includes a slotted cylinder 12 having a slot 14 formed longitudinally therein. Slot 14 is parallel with an axis 16. Slotted cylinder 12 is perpendicular to ground plane 18. Slotted cylinder is end fed by a coaxial feed including a center conductor 20 and an outer conductor 22. Center conductor 20 is insulated from ground plane 18 and joined to slotted cylinder 12 at a first side of slot 14. Outer conductor 22 is joined to ground plane 18 and to slotted cylinder 12 at a second side of slot 14 opposite the first side. A cylindrical shell 32 of a uniaxial dielectric material is provided outside slotted cylinder 12.

Cylindrical shell 32 is coaxial with slotted cylinder 12. A base end 34 of cylindrical shell 32 is joined to ground plane 18. A distal end 36 extends beyond end of slotted cylinder 12. Cylindrical shell 32 is made from a uniaxial dielectric material. This material has a diagonal dielectric tensor where only one of the components is greater than unity. In this case, that component is in the z direction so as to be parallel with the axis 16 of cylinder 12 and slot 14. The tensor in Cartesian coordinates is as follows:

$$\bar{\varepsilon} = \begin{pmatrix} 1 & 0 & 0 \\ 0 & 1 & 0 \\ 0 & 0 & \varepsilon_{zz} \end{pmatrix} \tag{1}$$

Modelling using this structure has been performed when the inner diameter of cylindrical shell 32 is just slightly larger than the outer diameter of slotted cylinder 12, thickness of shell 32 is 7.5% of its height, and when $\varepsilon_{zz}$ ranges from 9.0 to 11.0. This modelling found improvement in the bandwidth of the antenna 30 results. Bandwidth is improved because of the interaction between the near fields of the slotted cylinder 12 and cylindrical shell 32, resulting in a situation where the electric field in the slot 14 remains fairly constant over a wide range of frequencies. This improves the bandwidth.

Like the prior art antenna described with reference to FIG. 1, antenna 30 also has a cutoff frequency, $f_c$. The cutoff frequency $f_c$ is a function of the geometry of the antenna and slot. It has been found that a second form of cylindrical shell 32 having a different dielectric tensor can broaden the bandwidth of the antenna 32 when used at frequencies above cutoff frequency $f_c$. This dielectric tensor has the form:

$$\bar{\varepsilon} = \begin{pmatrix} \varepsilon_{xx} & 0 & 0 \\ 0 & \varepsilon_{yy} & 0 \\ 0 & 0 & 1 \end{pmatrix} \tag{2}$$

where $\varepsilon_{xx}=\varepsilon_{yy}\cong 8$.

Figure 5:
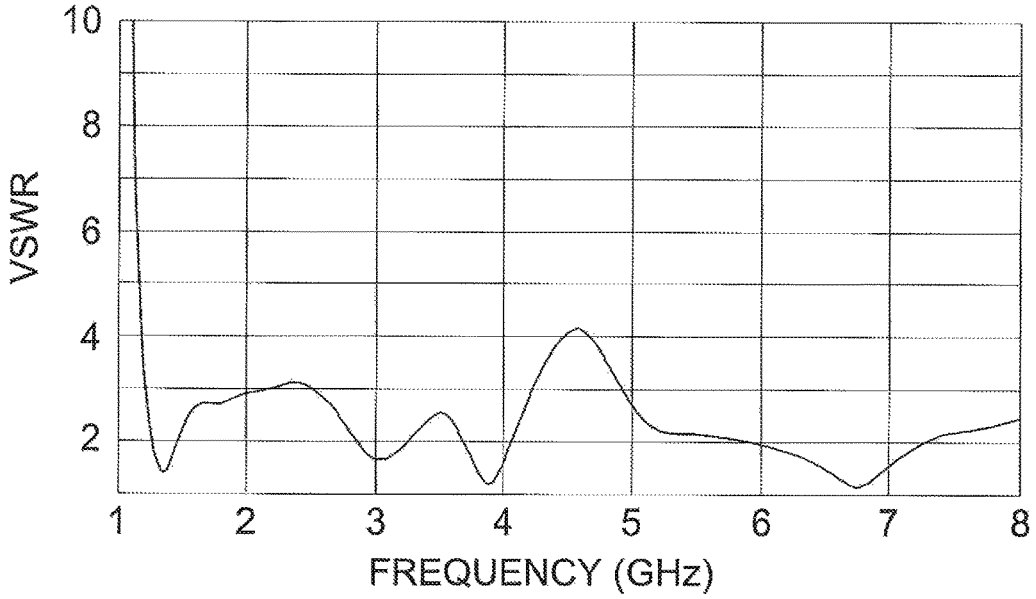
FIG. 5 is a graph of VSWR versus frequency for an antenna according to the current invention.
Figure 6:
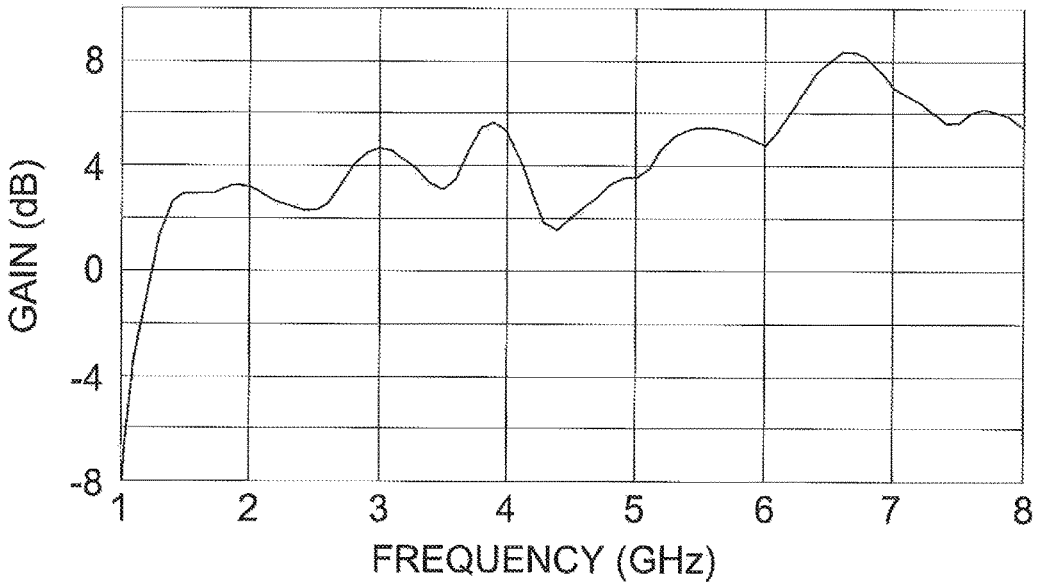
FIG. 6 is a graph of gain versus frequency for an antenna according to the current invention.

The computed VSWR of antenna 30 with the first dielectric tensor is shown in FIG. 5. Computed gain is shown in FIG. 6. The data in these two plots indicate that the bandwidth of antenna 30 has been dramatically improved, while the realized gain of the antenna has not been negatively impacted. Gain has been improved slightly in some portions of the passband. There is a region near 4.5 GHz in this example where the VSWR exceeds 3:1.

Figure 8:
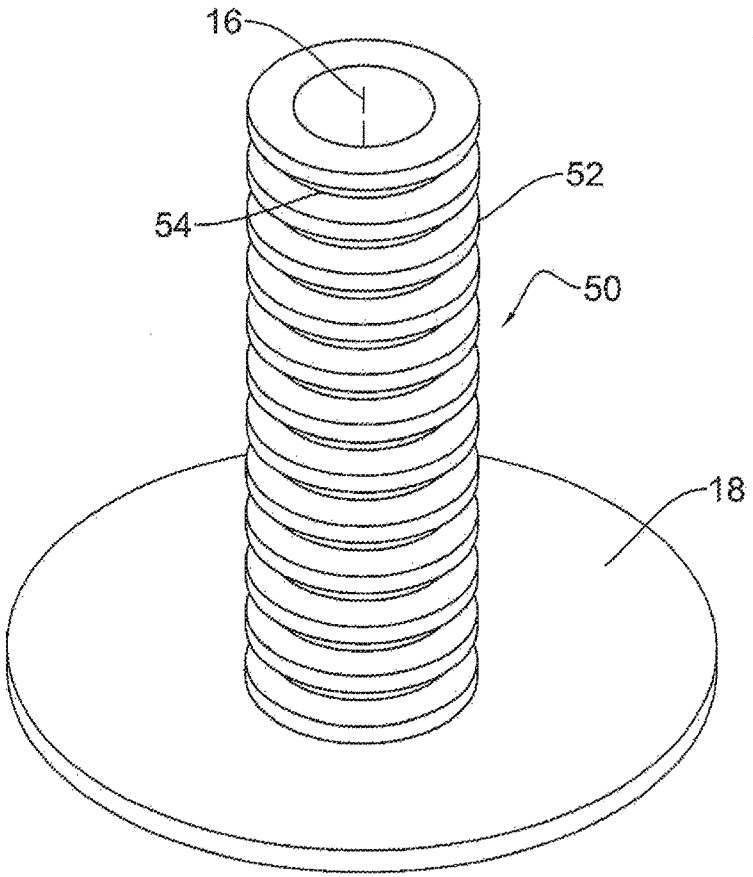
FIG. 8 is a perspective view of yet another embodiment of an antenna in accordance with the current invention.
Figure 7:
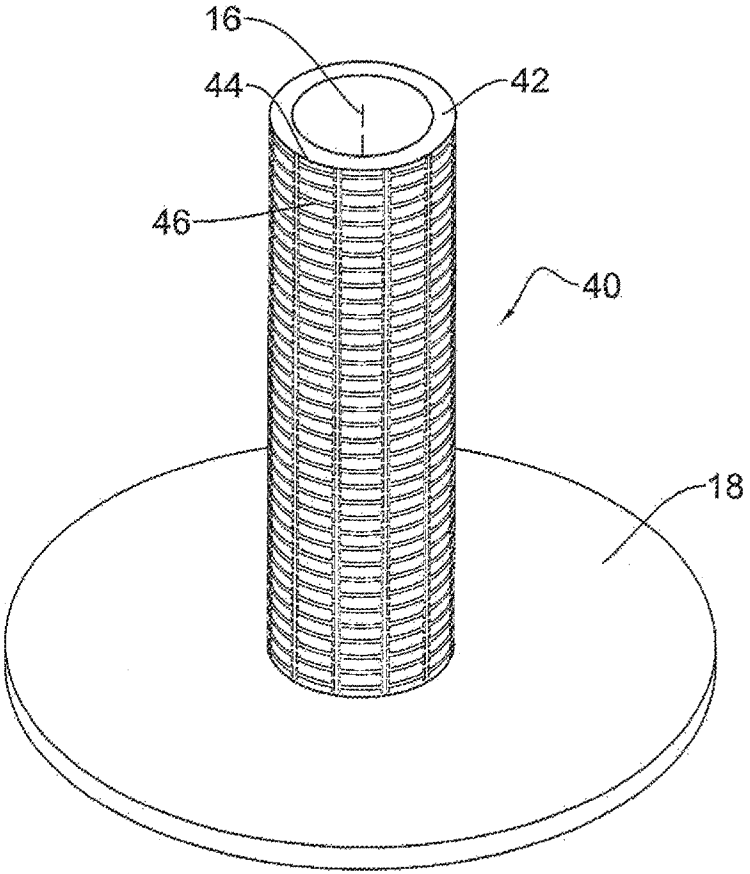
FIG. 7 is a perspective view of another embodiment of an antenna in accordance with the current invention.

FIGS. 7 and 8 contain computed gain and VSWR plots for antenna 30 has cylindrical shell 32 with a dielectric tensor such as that provided in equation 2, above.

Design parameters for this embodiment of antenna 30 are provided in the following table:

TABLE 1

| Slotted Cylinder | |
|---|---|
| Inner radius | 5 mm |
| Thickness | 1 mm |
| Height | 30 mm |
| Standoff | 5 mm |
| Slot Width | 2 mm |
| Cylindrical Shell | |
| Inner radius | 7 mm |
| Thickness | 3 mm |
| Height | 40 mm |
| Dielectric tensor | $\varepsilon_{xx} = \varepsilon_{yy} = 1$, $\varepsilon_{zz} = 8.5$ |

This antenna 30 works well when vertically mounted and fed by a coaxial line against a conductive ground plane 18. It also has a significantly improved bandwidth compared with an ordinary slotted cylinder antenna 10 that does not employ a uniaxial dielectric shell. This increase in bandwidth does not bring along an accompanying penalty in antenna realized gain.

Note that based on the data in Table 1, the antenna is "electrically small". This means that the antenna's physical length is small when compared to the wavelength of operation at the low end of the passband. A further advantage is that the uniaxial dielectric cylinder 32 has the effect of making the antenna 30 appear to be electrically longer than it is, without the increase in stored energy that would otherwise limit the bandwidth. This is a direct consequence of the uniaxial property of the dielectric cylinder and its orientation parallel to the slot. The increased electrical length allows a traveling wave mode to exist in the slot which aids in improving the bandwidth.

This antenna can be made by modifying existing slotted antennas by retrofitting these antennas with uniaxial dielectric shells. This will improve the bandwidth of the existing antenna and allow greater flexibility. The antenna can be structurally enhanced by filling the region within slotted cylinder 12 with a dielectric material. This material can be a syntactic foam or other material that doesn't affect the electromagnetic properties of the antenna. Likewise, the region between slotted cylinder 12 and shell 32 can also be filled with a dielectric material such as a syntactic foam.

This antenna can be scaled in frequency to accommodate functions in other portions of the radio frequency (RF) spectrum. For example, the data shown indicate a passband starting at approximately 1.3 GHz. If performance was desired starting at 650 MHz, the dimensions of the slotted cylinder and cylindrical shell could be doubled to produce the desired result.

Figure 1:
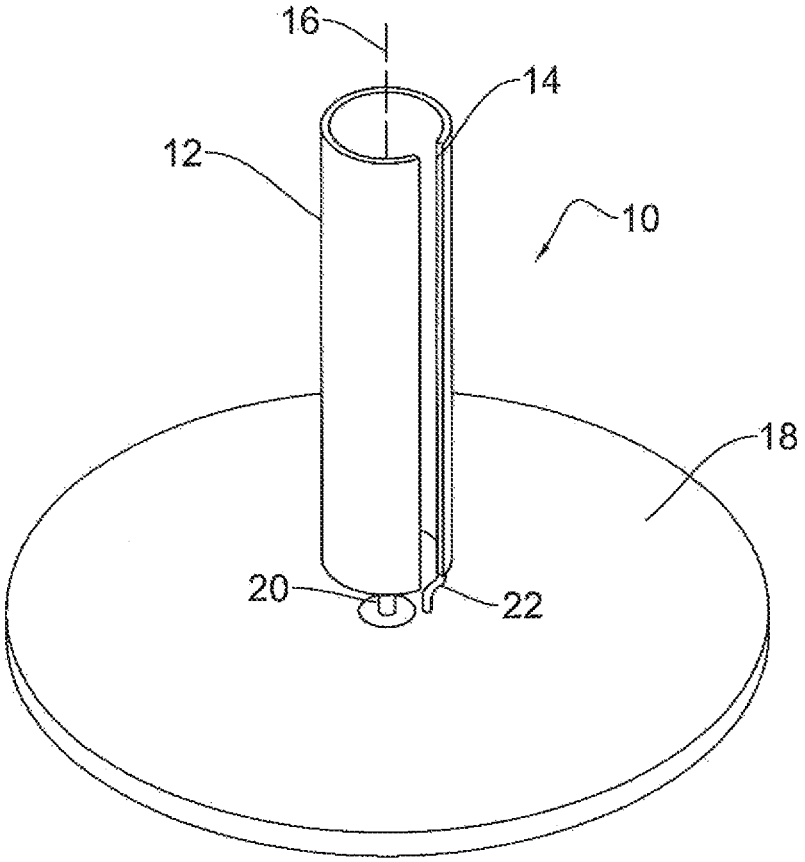
FIG. 1 (PRIOR ART)
FIG. 1 is a perspective view of a prior art antenna.
Figure 2:
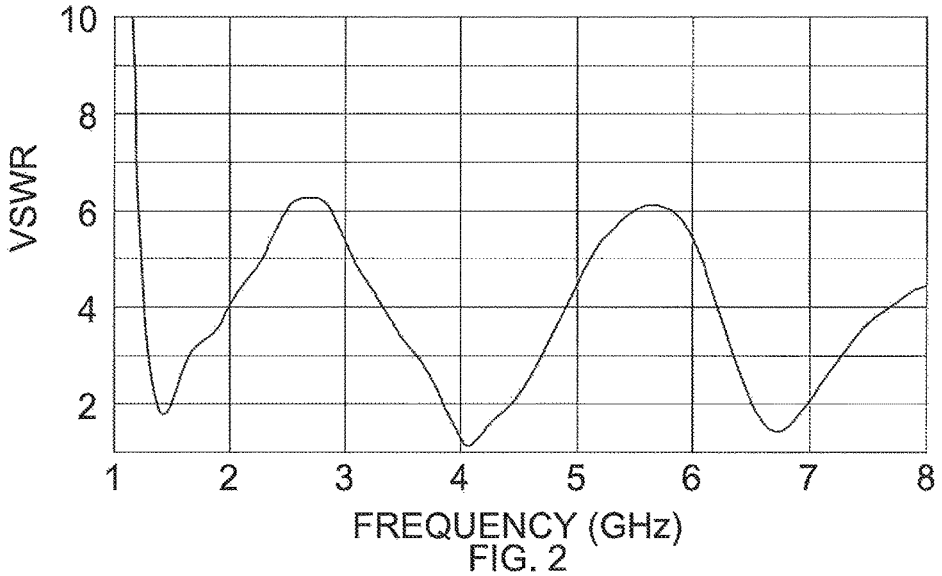
FIG. 2 (PRIOR ART)
FIG. 2 is a graph of VSWR versus frequency for a prior art slotted antenna.
Figure 3:
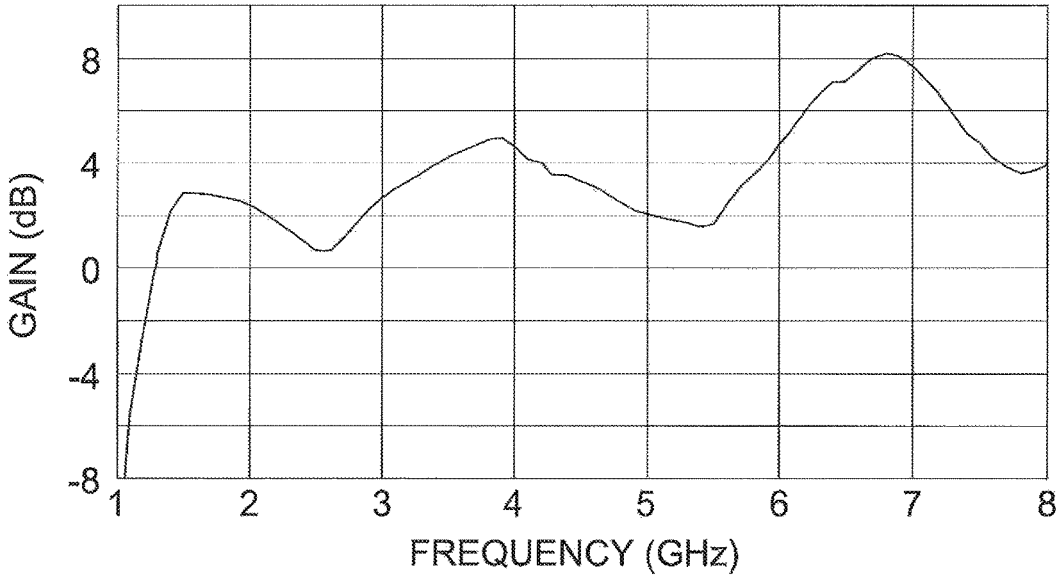
FIG. 3 (PRIOR ART)
FIG. 3 is a graph of gain versus frequency for the prior art antenna.

FIG. 7 shows an embodiment of a cover 40 for a slotted cylinder antenna mounted on a ground plane 18 such as that shown in FIG. 1. The hidden slotted cylinder antenna is not shown in FIG. 7 in order to reduce drawing complexity. Cover 40 is placed over the antenna and extends from ground plane 18 beyond a distal end of antenna. Cover 40 is coaxial with slotted cylindrical antenna as shown by axis 16. To obtain the proper dielectric tensor, cover 40 is made from a sheet 42 having an array of I shaped conductive strips wrapped on a polyvinyl chloride cylinder 44. I shaped conductive 46 strips are oriented with the vertical portion of the "I" being positioned circumferentially with respect to axis 16. Each I shaped conductive strip 46 is conductively isolated from adjacent strips, and these strips do not touch one another. Polyvinyl chloride cylinder 44 is provided only for support and can be made from any rigid non-conductive material that doesn't influence electromagnetic properties.

FIG. 8 shows another embodiment of a cover 50 for the slotted cylinder antenna of FIG. 1 mounted on a ground plane 18. Again, the hidden slotted cylinder antenna is not shown. Cover 50 is positioned coaxially with axis 16 of slotted cylinder antenna. Anisotropic covering, having the necessary dielectric tensor, can be implemented as a stack of alternating alumina ($Al_2O_3$) disks 52 and low-k dielectric foam disks 54. (Low-k refers to a material with a small dielectric constant.) These low-k disks 54 can be made from a plurality of different materials including styrofoam, syntactic foam and other materials having a similar dielectric constant. The disks 52 and 54 have an aperture 56 in the center accommodating the slotted cylinder antenna.

Figure 9:
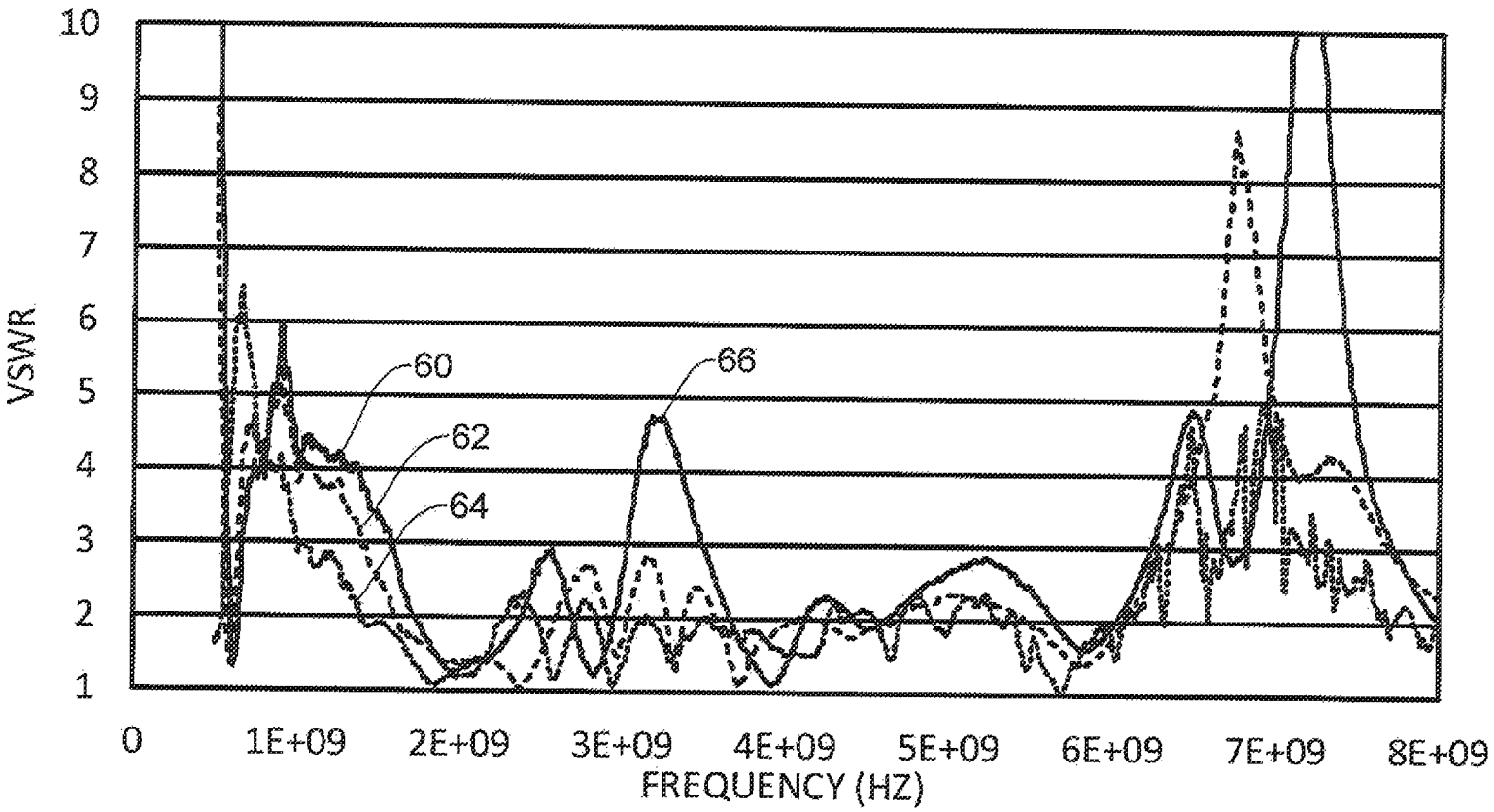
FIG. 9 is a graph comparing VSWR vs. frequency for the antennas of FIG. 1, FIG. 7 and FIG. 8.

FIG. 9 provides a comparative VSWR vs. Frequency graph comparing the two embodiments with the slotted cylinder antenna acting alone. This graph shows actual test results. The VSWR for the slotted cylinder antenna is shown by the solid line 60. For the I-shaped conductive stripe antenna, VSWR is shown by the dashed line 62. VSWR for the disk antenna is given by the dotted line 64. The band gap between 3 GHz and 4 GHz shown in the graph at 66 is effectively eliminated by both embodiments. These embodiments have an effective bandwidth of over two octaves.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An antenna capable of being joined to an antenna feed perpendicular to a ground plane comprising:

a conductive radiator being substantially tubular and having a slot formed therein from a first end of the conductive radiator to a second end of the conductive radiator parallel to an axis of the conductive radiator, the antenna feed being connectable to the conductive radiator adjacent to and across the slot; and a cylindrical shell of a uniaxial dielectric material is provided outside said conductive radiator and spaced apart therefrom and extending longitudinally beyond ends of said conductive radiator, said cylindrical shell being in electrical contact with the ground plane, said uniaxial dielectric material having a dielectric tensor having high impedance in the direction parallel to the axis of said conductive radiator.

2. The apparatus of claim 1 wherein said cylindrical shell is made from a material having a dielectric tensor of the form:

$$\bar{\varepsilon} = \begin{pmatrix} \varepsilon_{xx} & 0 & 0 \\ 0 & \varepsilon_{yy} & 0 \\ 0 & 0 & \varepsilon_{zz} \end{pmatrix}$$

wherein $\varepsilon_{xx}=\varepsilon_{yy}=1$ and $\varepsilon_{zz}$ is between 8 and 11.

3. The apparatus of claim 2 wherein said cylindrical shell is formed from an engineered composite material to have the specified dielectric tensor.

4. The apparatus of claim 1 further comprising a substantially solid dielectric material disposed in the interior of said conductive radiator.

5. The apparatus of claim 4 wherein the substantially solid dielectric material is a syntactic foam having the required dielectric properties.

6. The apparatus of claim 1 further comprising a substantially solid dielectric material disposed between said conductive radiator and said cylindrical shell.

7. The apparatus of claim 6 wherein the substantially solid dielectric material is a syntactic foam having the required dielectric properties.

8. The apparatus of claim 1 wherein said cylindrical shell is made from a material having a dielectric tensor of the form:

$$\bar{\varepsilon} = \begin{pmatrix} \varepsilon_{xx} & 0 & 0 \\ 0 & \varepsilon_{yy} & 0 \\ 0 & 0 & \varepsilon_{zz} \end{pmatrix}$$

wherein $\varepsilon_{xx}$ and $\varepsilon_{yy}$ are about 8 and $\varepsilon_{zz}=1$.

9. The apparatus of claim 8 wherein said cylindrical shell is formed from an engineered composite material to have the specified dielectric tensor.

10. The apparatus of claim 1 wherein said cylindrical shell is formed from a cylinder of rigid dielectric material having an array of conductive strips disposed on an outer surface thereof.

11. The apparatus of claim 1 wherein said cylindrical shell is formed from alternating longitudinal layers of alumina and low-k materials.

12. An apparatus for improving the bandwidth of a slotted cylindrical antenna vertically disposed over a ground plane comprising:

a cylindrical shell of a uniaxial dielectric material is provided outside the slotted cylindrical antenna and spaced apart therefrom and extending longitudinally beyond ends of the slotted cylindrical antenna, said cylindrical shell being in electrical contact with the ground plane, said uniaxial dielectric material having a dielectric tensor having high impedance in the direction parallel to the axis of the slotted cylindrical antenna.

13. The apparatus of claim 12 wherein said cylindrical shell is made from a material having a dielectric tensor of the form:

$$\bar{\varepsilon} = \begin{pmatrix} \varepsilon_{xx} & 0 & 0 \\ 0 & \varepsilon_{yy} & 0 \\ 0 & 0 & \varepsilon_{zz} \end{pmatrix}$$

wherein $\varepsilon_{xx}=\varepsilon_{yy}=1$ and $\varepsilon_{zz}$ is between 8 and 11.

14. The apparatus of claim 13 wherein said cylindrical shell is formed from an engineered composite material to have the specified dielectric tensor.

15. The apparatus of claim 12 further comprising a substantially solid dielectric material disposed between the slotted cylindrical antenna and said cylindrical shell.

16. The apparatus of claim 15 wherein the substantially solid dielectric material is a syntactic foam having the required dielectric properties.

17. The apparatus of claim 12 wherein said cylindrical shell is made from a material having a dielectric tensor of the form:

$$\bar{\varepsilon} = \begin{pmatrix} \varepsilon_{xx} & 0 & 0 \\ 0 & \varepsilon_{yy} & 0 \\ 0 & 0 & \varepsilon_{zz} \end{pmatrix}$$

wherein $\varepsilon_{xx}$ and $\varepsilon_{yy}$ are about 8 and $\varepsilon_{zz}=1$.

18. The apparatus of claim 17 wherein said cylindrical shell is formed from an engineered composite material to have the specified dielectric tensor.

19. The apparatus of claim 12 wherein said cylindrical shell is formed from a cylinder of rigid dielectric material having an array of conductive strips disposed on an outer surface thereof.

20. The apparatus of claim 12 wherein said cylindrical shell is formed from alternating longitudinal layers of alumina and low-k materials.

* * * * *